United States Patent [19]

Jacobson

[11] Patent Number: 4,518,364

[45] Date of Patent: May 21, 1985

[54] SWIMMING INSTRUCTION DEVICE

[76] Inventor: Vivian R. Jacobson, 3557 W. Hollywood Ave., Chicago, Ill. 60659

[21] Appl. No.: 537,804

[22] Filed: Sep. 30, 1983

[51] Int. Cl.[3] ..... A63B 31/00

[52] U.S. Cl. ..... 441/129; 441/136; 434/254

[58] Field of Search ..... 434/254, 421, 403, 428, 434/429, 432; 441/65, 129, 136; 272/1 B; 40/11 R, 10 R, 156; 350/114, 241, 243; 273/295; 248/451, 452, 453

[56] References Cited

U.S. PATENT DOCUMENTS

| | | | |
|---|---|---|---|
| D. 55,079 | 5/1920 | Ranlett | D71/1 |
| D. 157,564 | 3/1950 | Byerly | D71/1 |
| D. 175,764 | 10/1955 | Dotson | D71/1 |
| D. 183,016 | 6/1958 | O'Herron | D71/1 |
| D. 187,677 | 4/1960 | Hollington | D71/1 |
| D. 189,273 | 11/1960 | Saeman | D71/1 |
| D. 195,384 | 6/1963 | Del Mar | D71/1 |
| D. 199,470 | 10/1964 | Ziff | D71/1 |
| D. 200,680 | 3/1965 | Wilson | D71/1 |
| D. 203,365 | 12/1965 | Heston, Jr. | D71/1 |
| D. 246,066 | 10/1977 | O'Farrell | D34/42 |
| D. 246,926 | 1/1978 | Cone | D21/1 |
| D. 264,370 | 5/1982 | McCarthy | D21/237 |
| 1,402,529 | 1/1922 | Nichols | 441/74 |
| 2,341,884 | 2/1944 | Sowa | 273/295 X |
| 2,521,256 | 9/1950 | Salter | 350/114 X |
| 2,536,390 | 1/1951 | Pobochenko | 441/56 |
| 2,709,266 | 5/1955 | Munn | 441/56 |
| 2,712,139 | 7/1955 | Kelly | 441/135 |
| 2,850,748 | 9/1958 | Read | 441/56 |
| 2,974,331 | 3/1961 | Dize | 441/130 |
| 3,044,186 | 7/1962 | Berger | 272/1 B |
| 3,045,262 | 7/1962 | Mitchell | 441/136 |
| 3,085,356 | 4/1963 | Wayfield | 434/254 |
| 3,124,815 | 3/1964 | Harvey | 441/55 |
| 3,147,498 | 9/1964 | Convis | 441/65 |
| 3,373,450 | 3/1968 | Brooks | 434/254 |
| 3,533,591 | 10/1970 | Wightman | 248/452 |
| 3,618,231 | 11/1971 | Nason | 273/295 |
| 3,786,526 | 1/1974 | Ausseil | 272/71 |
| 3,808,621 | 5/1974 | French | 114/66 |
| 4,227,273 | 10/1980 | Lucciola | 434/254 |
| 4,258,914 | 3/1981 | Lalli | 272/71 |
| 4,293,126 | 10/1981 | Havens | 272/119 |
| 4,300,759 | 11/1981 | Caplan | 272/116 |
| 4,302,007 | 11/1981 | Oprean et al. | 272/116 |

FOREIGN PATENT DOCUMENTS

| | | |
|---|---|---|
| 1306873 | 12/1962 | France . |
| 2327805 | 5/1977 | France . |

*Primary Examiner*—Sherman D. Basinger

*Attorney, Agent, or Firm*—Joseph R. Marcus; Gerald S. Schur; Robert S. Beiser

[57] ABSTRACT

A swimming instruction device in the form of a kickboard having a top surface and a bottom surface. The kickboard is buoyant to float on water with at least a portion of the bottom surface in contact with the water and the top surface facing upwardly and away from the water. Additionally, the kickboard includes at least one guide member adapted to receive a swimming instruction card.

7 Claims, 7 Drawing Figures

SWIMMING INSTRUCTION DEVICE

BACKGROUND OF THE INVENTION

The present invention relates to swimming instruction devices and, more particularly, to a swimming instruction device in the form of a kickboard.

In the past, many different forms of swimming instruction have been available depending upon the swimmer's ability. These have ranged from the most basic type of training for beginners usually involving personalized instruction in the classroom and in the water, to self-help instructional materials in the form of books and pamphlets on swimming and related exercises, to the use of various devices such as kickboards, weights, and other resistance means for use in the water to aid in building strength particularly for those involved in competitive swimming. However, a real need has remained for swimmers who wish to practice the techniques they have learned from reading or in the classroom.

In particular, it is common for a swimmer to be instructed in various strokes and breathing techniques to later be practiced in the water. These strokes and breathing techniques can be taught both in the classroom and in the pool by means of individualized instruction, and they can also be learned by reading one or more of the books or pamphlets available on swimming instruction, but it is difficult if not impossible for the swimmer to later recall all of the details of such instruction when it is desired to practice the strokes and breathing in the water at a point subsequent to receiving such instruction. As a result, the advancement of the swimmer in learning the various strokes and breathing techniques has been impeded by the absence of suitable swimming instruction devices.

It is, therefore, an object of the present invention to provide a swimming instruction device capable of being used by the swimmer in the water for the purpose of reviewing swimming instructions during a practice session.

SUMMARY OF THE INVENTION

Accordingly, the present invention is directed to a swimming instruction device in the form of a kickboard having a top surface and a bottom surface. The kickboard is buoyant to float on water with at least a portion of the bottom surface in contact with the water and the top surface facing upwardly and away from water. In addition, the kickboard includes means for carrying swimming instructions on the top surface thereof.

More particularly, the swimming instructions carrying means includes at least one guide member adapted to receive a swimming instruction card. However, it preferably includes a second guide member adapted to receive a swimming instruction card with the guide members being disposed in spaced parallel relation on the top surface of the kickboard. Moreover, each of the guide members includes a card retaining flange extending toward the other of the guide members.

With this arrangement, the swimming instruction card is adapted to be inserted between the guide members. The card is inserted by sliding the card under the card retaining flanges in a direction parallel to the guide members and along the top surface of the kickboard. As a result, the card retaining flanges can hold the swimming instruction card in position for viewing swimming instructions thereon.

As will be appreciated, the swimming instruction device includes means for securing the guide members to the top surface of the kickboard. The securing means is disposed outwardly of the card retaining flanges so as to permit the swimming instruction card to be inserted by sliding the card under the card retaining flanges. In other words, the card retaining flanges extend from the securing means and, preferrably, are disposed in spaced relation to the top surface of the kickboard.

Preferably, the swimming instruction device also includes a pair of depressions in the top surface of the kickboard adapted for finger insertion. The depressions are disposed along opposite sides of the kickboard intermediate the guide members to permit the swimming instruction card to be gripped for removal to allow for subsequent insertion of another such card. Also, the swimming instruction device preferrably includes a card stop disposed along each side of the kickboard outwardly adjacent the depressions to prevent the swimming instruction card from inadvertently becoming separated from the kickboard.

Additionally, the portion of the top surface between the securing means can be recessed. The card retaining flanges then extend over and parallel to the recessed portion of the top surface and the securing means suitably comprises a fastener receiving flange associated with each of the guide members and a plurality of fastener receiving bosses formed in the top surface of the kickboard adjacent the recessed portion thereof. Moreover, transparent cover means adapted to be positioned over the swimming instruction card may be provided for sliding insertion under the card retaining flanges.

In a preferred embodiment, a plurality of swimming instruction cards are adapted to be carried by the swimming instructions carrying means. The swimming instruction cards are arrangable so that any one of the cards can be disposed in position for viewing swimming instructions thereon at any point in time. In addition, the swimming instruction cards are advantageously formed of water proof material and the transparent cover means advantageously includes integral magnification.

These and other objects, features and advantages of the present invention will become apparent from the following description when considered in connection with the accompanying drawings.

DETAILED DESCRIPTION OF THE PREFERRED EMBODIMENT

Figure 1:
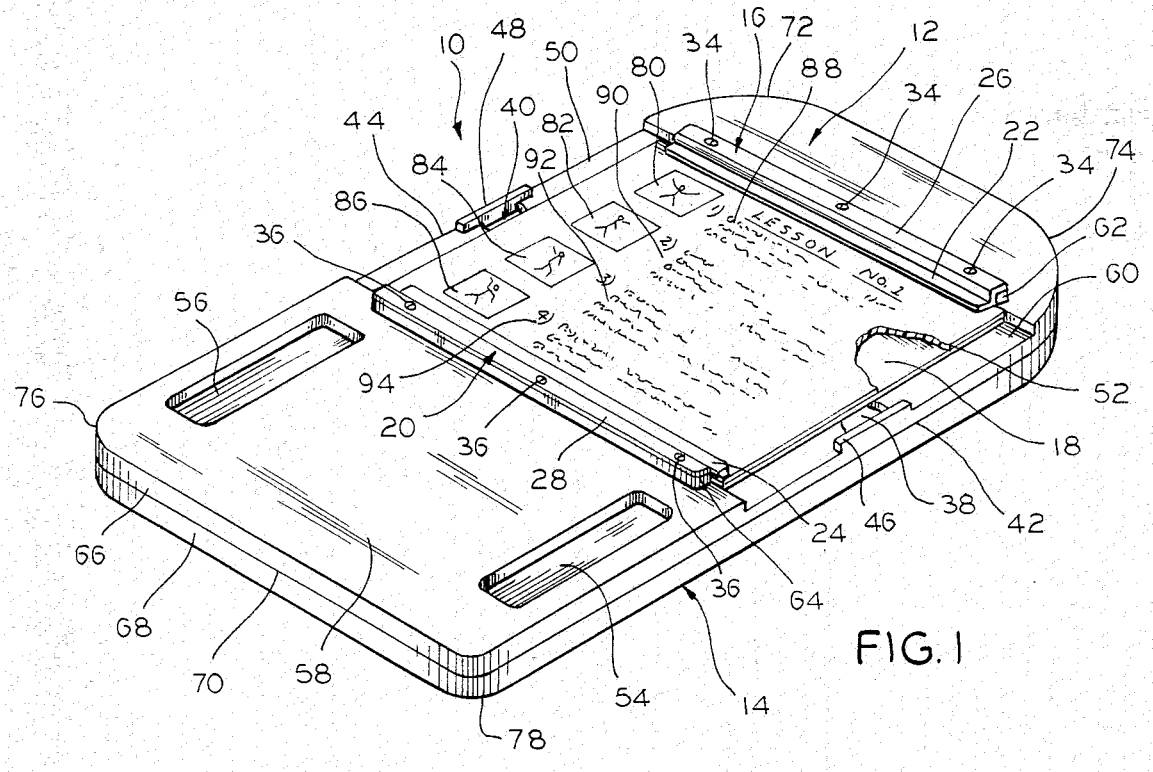
FIG. 1 is a perspective view of a swimming instruction device in accordance with the present invention.

In the illustration given, and with reference first to FIG. 1, the reference 10 designates generally a swimming instruction device in accordance with the present invention. The swimming instruction device 10 is in the form of a kickboard having a top surface 12 and a bottom surface 14 and the kickboard is buoyant to float on water with at least a portion of the bottom surface 14 in contact with the water. Moreover, the top surface 12 faces upwardly and away from the water and includes means for carrying swimming instructions thereon (as will be described in detail hereinafter).

Still referring to FIG. 1, the swimming instructions carrying means includes at least one guide member 16 adapted to receive a swimming instruction card 18. In the preferred embodiment, the swimming instructions carrying means will include a second guide member 20 also adapted to receive the swimming card 18 and the guide members 16 and 20 will be disposed in spaced parallel relation on the top surface 12 of the kickboard 10. As shown, the guide members 16 and 20 each include a card retaining flange 22 and 24, respectively, extending toward the other of the guide members.

As will be appreciated, the swimming instruction card 18 is adapted to be inserted between the guide members 16 and 20. The card 18 is inserted by sliding it under the card retaining flanges 22 and 24 in a direction parallel to the guide members 16 and 20 and along the top surface 12 of the kickboard 10. When this has been done, the card retaining flanges 16 and 20 hold the swimming instruction card 18 in position for viewing swimming instructions thereon.

Figure 4:
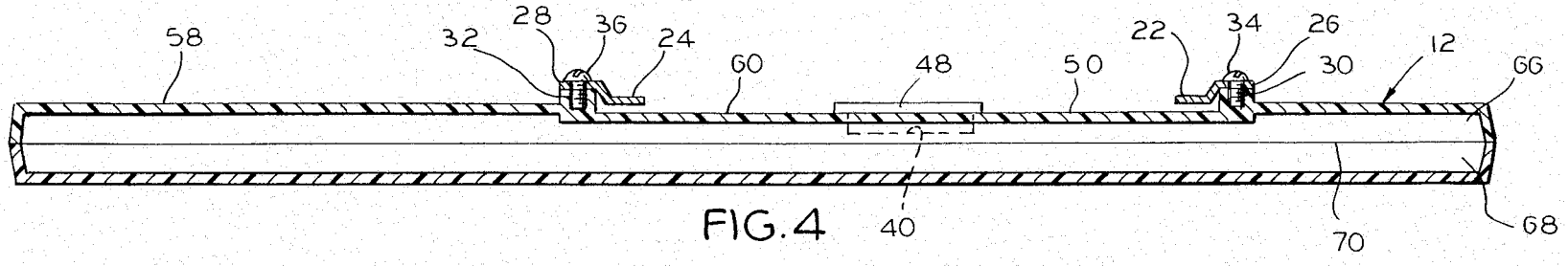
FIG. 4 is a cross-sectional view taken on the line 4—4 of FIG. 2.
Figure 5:
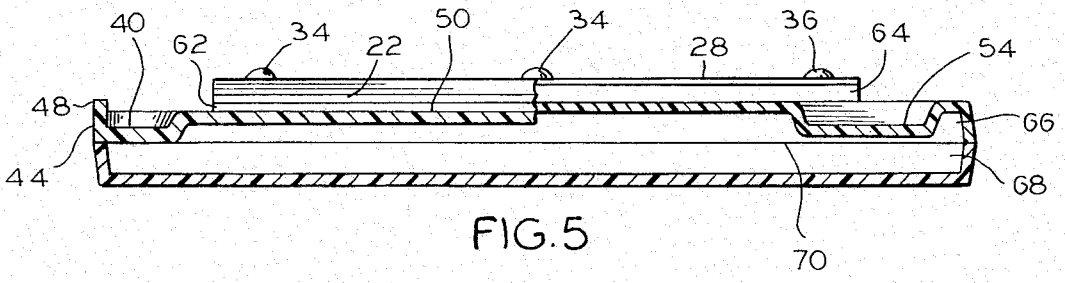
FIG. 5 is a cross-sectional view taken on the line 5—5 of FIG. 2.

As shown, the kickboard 10 includes means for securing the guide members 16 and 20 to the top surface thereof. The securing means comprise fastener receiving flanges 26 and 28 associated with each of the guide members 16 and 20, respectively, together with a plurality of fastener receiving bosses 30 and 32 (see FIG. 4) together with an equal number of fasteners 34 and 36 and the fastener receiving flanges 26 and 28 as well as the fastener receiving bosses 30 and 32 are disposed outwardly of the card retaining flanges 22 and 24 so as to permit the swimming instruction card 18 to be inserted by sliding the card under the card retaining flanges. Moreover, as shown in FIG. 4, the card retaining flanges 22 and 24 extend from the fastener receiving flanges 26 and 28 and the fastener receiving bosses 30 and 32 in spaced parallel relation to the top surface 12 of the kickboard 10.

Figure 2:
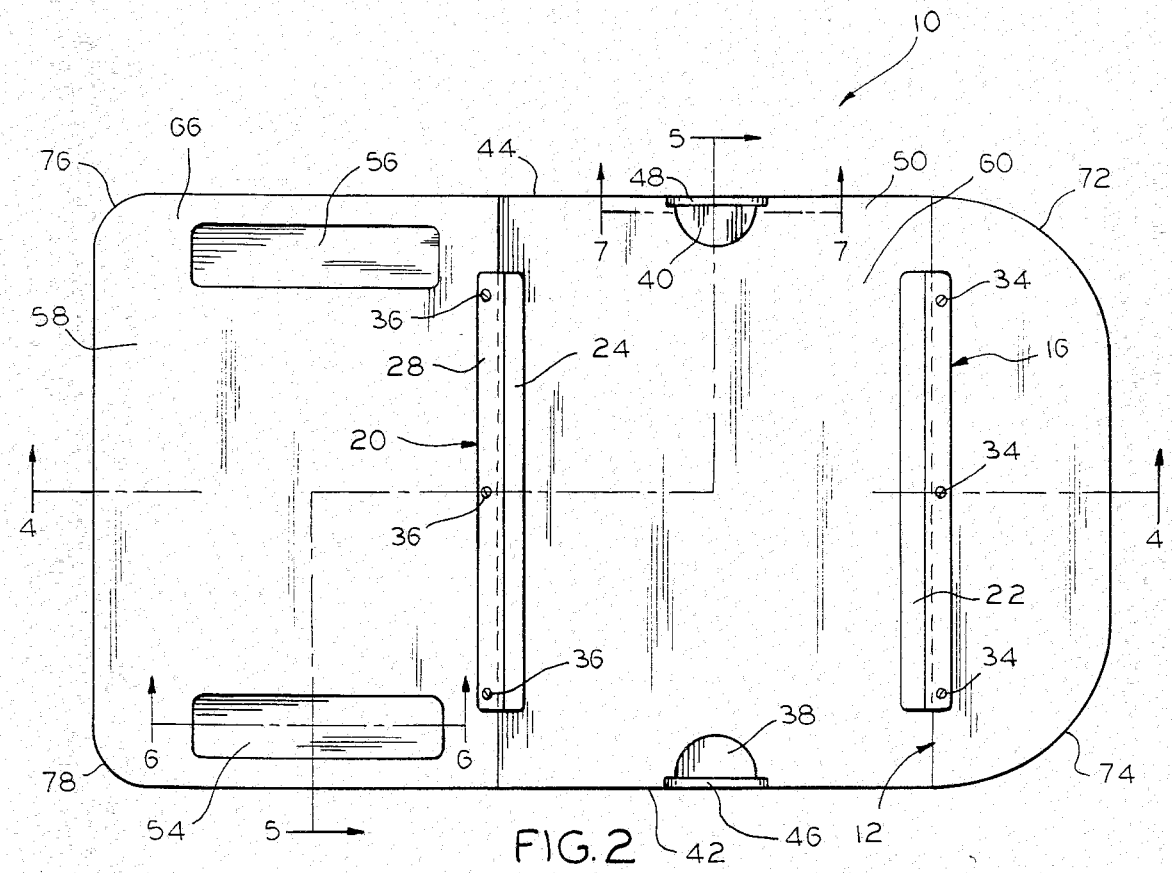
FIG. 2 is a plan view of the swimming instruction device of FIG. 1.
Figure 7:
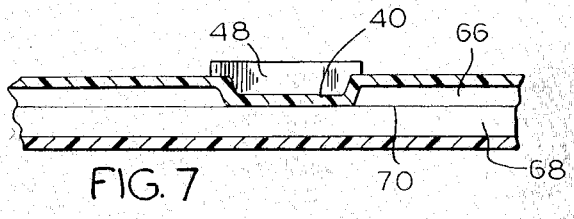
FIG. 7 is a cross-sectional view taken on the line 7—7 of FIG. 2.

Referring to FIGS. 2 and 7, the kickboard 10 includes at least one depression 38 in the top surface 12 adapted for finger insertion. In a preferred embodiment, a pair of depressions 38 and 40 are provided and disposed along each side 42 and 44 of the kickboard 10 intermediate the guide members 16 and 20 and a card stop 46 and 48 is disposed along each side 42 and 44, respectively, of the kickboard 10 outwardly adjacent the respective depressions 38 and 40. As will be appreciated, the card stops 46 and 48 prevent the swimming instruction card 18 from inadvertently becoming separated from the kickboard 10.

Figure 3:
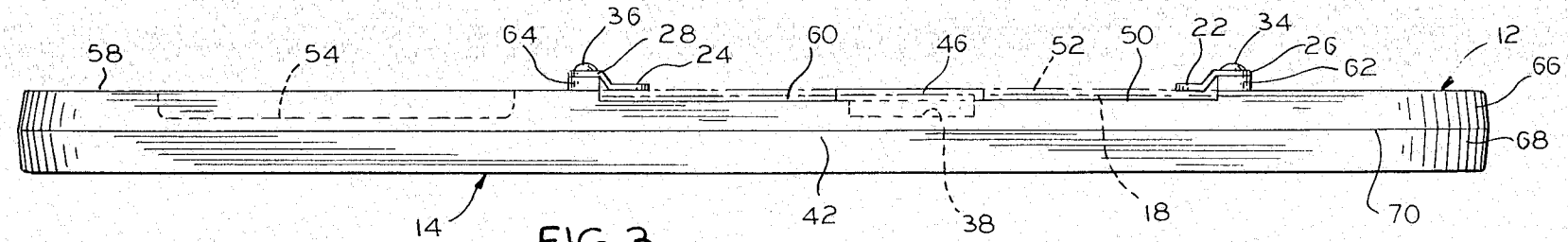
FIG. 3 is a side elevational view of the swimming instruction device of FIG. 1.

As shown in FIGS. 1 and 3, the portion 50 of the top surface 12 between the fastener receiving flanges 26 and 28 and the fastener receiving bosses 30 and 32 is recessed. The card retaining flanges 22 and 24 then extend over and parallel to the recessed portion 50 of the top surface 12 in spaced relation thereto and, as a result, a transparent cover 52 adapted to be positioned over the swimming instruction card 18 may be inserted between the guide members 16 and 20 by sliding the cover 52 under the card retaining flanges 22 and 24 into the position shown in FIG. 1. After so doing, the card retaining flanges 22 and 24 hold the transparent cover 52 over the swimming instruction card 18 in position for viewing swimming instructions thereon.

In the preferred embodiment of the invention, a plurality of swimming instruction cards adapted to be carried by the swimming instructions carrying means is provided. The swimming instruction cards (such as 18) are arrangable so that any one of the cards can be disposed in position for viewing swimming instructions thereon. In addition, the swimming instruction cards (such as 18) can advantageously be formed of water proof material.

As previously mentioned, the transparent cover 52 is adapted to be positioned over the swimming instruction cards. It will be appreciated that the cards are simply stacked one upon another and inserted under the transparent cover 52 with the card of interest at any one time on top so that the card can be viewed through the transparent cover which is held in position (as are all of the cards) by the card retaining flanges 22 and 24. In order to enhance vision of the cards, the transparent cover 52 can be provided with integral magnification particularly for those who normally where eyeglasses.

Figure 6:
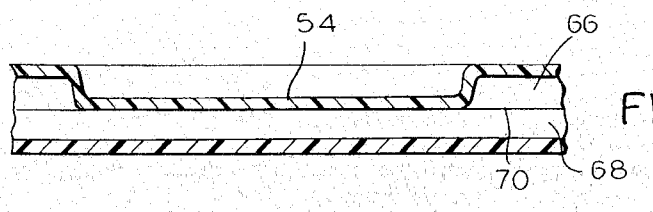
FIG. 6 is a cross-sectional view taken on the line 6—6 of FIG. 2.

As shown in the drawings, the kickboard 10 is generally rectangular in shape. The kickboard 10 can advantageously be constructed of a plastic material so as to be hollow (see, for instance, FIGS. 4 through 7) to provide buoyancy and it can have a pair of depressions 54 and 56 in the top surface 12 thereof with one of the depressions 54 and 56 extending longitudinally along each side 42 and 44, respectively, in the rearward portion 58 thereof to provide means for gripping the kickboard (see, for instance, FIG. 6). As shown, the fastener receiving flanges 26 and 28 are disposed in the forward portion 60 of the kickboard 10 (see FIG. 2).

While the exact construction is not critical, it has been found advantageous for the bosses 30 and 32 to be formed in raised steps 62 and 64 (see FIGS. 1 and 3). The raised steps 62 and 64 help to define the bosses 30 and 32, respectively, and give support for fasteners such as the screws 34 and 36 that pass through the fastener receiving flanges 26 and 28 and, coupled with the recessed portion 50 of the top surface 12, give a desired amount of separation between the card retaining flanges 22 and 24 and the surface of the recessed portion 50 of the top surface 12 for insertion of a plurality of swimming instruction cards (such as 18) in addition to the transparent cover 52. With this arrangement, the guide members 16 and 20 are preferably constructed of plastic so that the card retaining flanges 22 and 24 have some flexibility to act as a clip to hold the transparent cover 52 and swimming instruction cards 18 in position for viewing swimming instructions on the top card.

In addition, the kickboard 10 is preferrably constructed so that the depressions 38 and 40 extend inwardly from the sides 42 and 44 sufficiently to pass under the swimming instruction cards 18. Similarly, the swimming instruction cards 18 and the transparent cover 52 are preferrably constructed so as to be of a width less than the distance between the card stops 46 and 48. With this construction, the swimming instruction cards 18 can be gripped and removed for subsequent rearrangement so that another of the cards can be disposed in position for viewing swimming instructions thereon.

As shown, the kickboard 10 is molded in two parts. The upper part 66 bearing the top surface 12 and the lower part 68 bearing the bottom surface 14 are subsequently sealed together along the seam line 70. While not essential, it is believed that this expedites construction of a hollow interior to provide buoyancy.

Referring to FIG. 2, it will appreciated that the kickboard 10 has rounded corners. In particular, the forward portion of the board 60 is provided with rounded corners 72 and 74 of a substantially greater radius than the rounded corners 76 and 78 of the rearward portion 58 thereof. However, in general, the kickboard 10 is generally rectangular in shape but can be varied to other shapes capable of incorporating means for carrying swimming instructions on the top surface thereof.

Referring to FIG. 1, the swimming instruction cards 18 can include drawings or photographs (such as 80, 82, 84 and 86), written instructions (such as 88, 90, 92 and 94), or both. It has also been found that the cards can be formed of water proof material such as the material sold under the trademark KIMDURA by Kimberley-Clark Corporation of Neenah, Wis. Also, with regard to the transparent cover 52, it can advantageously be formed of material bearing a large area Fresnel lens with 4× magnification in accordance with material presently available from Graham-Horde Inc. of Lauderdale by the Sea, Fla.

With the present invention, swimming instructions can actually be provided on the top surface 12. It is anticipated, for instance, that it would be desirable to provide improved breathing techniques for swimming efficiently directly on the recessed portion 50 of the top surface 12 and to provide a book of complete swimming instructions comprised of the swimming instruction cards 18 in looseleaf form that can be removed from a looseleaf binder and used with the kickboard 10 in the water and can later be returned to the looseleaf binder for study between practice sessions. In addition, the kickboard 10 and looseleaf book comprised of cards 18 can be provided with a carrying case having suitable compartments for a swimsuit, towel, and other swimming accessories.

Various changes coming within the spirit of the present invention may suggest themselves to those skilled in the art. Hence, it will be understood that the invention is not to be limited to the specific embodiment shown and described or the uses mentioned. On the contrary, the specific embodiment and uses are intended to be merely exemplary with the present invention being limited only by the true spirit and scope of the appended claims.

I claim:

1. A swimming instruction device, comprising;

a kickboard having a top surface and a bottom surface, said kickboard being buoyant to float on water with at least a portion of said bottom surface in contact with the water and said top surface facing upwardly and away from the water, said kickboard including means for selective attachment of swimming instruction to said top surface thereof, said means for selective attachment of swimming instructions including a plurality of guide members adapted to receive a swimming instruction card:

said guide members being disposed in spaced parallel relation on said top surface of said kickboard, said guide members each including a card retaining flange extending toward the other of said guide members.

2. The swimming instruction device as defined by claim 1 wherein said swimming instruction card is adapted to be inserted between said guide members, said card being inserted by sliding said card under said card retaining flanges in a direction parallel to said guide members and along said top surface of said kickboard, said card retaining flanges holding said swimming instruction card in position for viewing swimming instructions thereon.

3. The swimming instruction device as defined by claim 2 including means for securing said guide members to said top surface of said kickboard, said securing means being disposed outwardly of said card retaining flanges so as to permit said swimming instruction card to be inserted by sliding said card under said card retaining flanges, said card retaining flanges extending from said securing means in spaced relation to said top surface of said kickboard.

4. The swimming instruction device as defined by claim 3 including transparent cover means adapted to be positioned over said swimming instruction card, said transparent cover means being inserted between said guide members by sliding said cover means under said card retaining flanges, said card retaining flanges holding said transparent cover means over said swimming instruction card in position for viewing swimming instructions thereon.

5. A swimming instruction device, comprising;

a kickboard having a top surface and a bottom surface, said kickboard being buoyant to float on water with at least a portion of said bottom surface in contact with the water and said top surface facing upwardly and away from the water, said kickboard including means for selective fixed attachment of swimming instructions to said top surface thereof;

said means for fixed attachment of swimming instructions including first and second guide members adapted to receive a swimming instruction card, said guide members being disposed in spaced parallel relation on said top surface of said kickboard, said guide members each including a card retaining flange extending toward the other of said guide members;

said swimming instruction card being adapted to be inserted between said guide members, said card being inserted by sliding said card under said card retaining flanges in a direction parallel to said guide members and along said top surface of said kickboard, said card retaining flanges holding said swimming instruction card in position for viewing swimming instructions thereon; and, said swimming instruction device further including at least one depression in said top surface of said kickboard adapted for finger insertion, said depression being disposed along one side of said kickboard intermediate said guide members, said depression permitting said swimming instruction card to be gripped for removal to allow for subsequent insertion of another such card.

6. The swimming instruction device as defined by claim 5 including a pair of depressions for finger insertion, one of said depressions being disposed along each side of said kickboard intermediate said guide members and a card stop disposed along each side of said kickboard outwardly adjacent said depressions, said card stops preventing said swimming instruction card from inadvertently becoming separated from said kickboard.

7. A swimming instruction device, comprising:

a kickboard having a top surface and a bottom surface, said kickboard being buoyant to float on water with at least a portion of said bottom surface in contact with the water and said top surface facing upwardly and away from the water, said kickboard including means for selective fixed attachment of swimming instructions to said top surface thereof;

said means for selective fixed attachment of swimming instructions including first and second guide members adapted to receive a swimming instruction card, said guide members being disposed in spaced parallel relation on said top surface of said kickboard, said guide members each including a card retaining flange extending toward the other of said guide members;

said swimming instruction card being adapted to be inserted between said guide members, said card being inserted by sliding said card under said card retaining flanges in a direction parallel to said guide members and along said top surface of said kickboard, said card retaining flanges holding said swimming instruction card in position for viewing swimming instructions thereon;

said swimming instruction device further including means for securing said guide members to said top surface of said kickboard, said securing means being disposed outwardly of said card retaining flanges so as to permit said swimming instruction card to be inserted by sliding said card under said card retaining flanges, said card retaining flanges extending from said securing means in spaced relation to said top surface of said kickboard; and, the portion of said top surface between said securing means being recessed, said card retaining flanges extending over and parallel to said recessed portion of said top surface and said securing means comprising a fastener receiving flange associated with each of said guide members, said securing means also including a plurality of fastener receiving bosses formed in said top surface adjacent said recessed portion thereof.

* * * * *